US006572489B2

(12) United States Patent
Miyamoto et al.

(10) Patent No.: US 6,572,489 B2
(45) Date of Patent: Jun. 3, 2003

(54) GOLF CLUB HEAD

(75) Inventors: Masahiko Miyamoto, Hiratsuka (JP); Yoh Nishizawa, Hiratsuka (JP); Masaki Akie, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 10/080,591

(22) Filed: Feb. 25, 2002

(65) Prior Publication Data

US 2002/0160853 A1 Oct. 31, 2002

(30) Foreign Application Priority Data

Feb. 26, 2001 (JP) ..... 2001-050092

(51) Int. Cl.[7] ..... A63B 53/04

(52) U.S. Cl. ..... 473/291; 473/330; 473/345; 473/290; 473/314; 473/349

(58) Field of Search ..... 473/345, 330, 473/324, 334, 349, 333, 314, 290, 291

(56) References Cited

U.S. PATENT DOCUMENTS 5,078,400 A * 1/1992 Desbiolles et al. ..... 473/349
5,271,620 A * 12/1993 Moriguchi et al. ..... 473/324
5,397,127 A * 3/1995 Kawada et al. ..... 473/324
5,681,228 A * 10/1997 Mikame et al. ..... 473/330
5,709,617 A * 1/1998 Nishimura et al. ..... 473/330
5,935,020 A * 8/1999 Stites et al. ..... 473/345
6,045,455 A * 4/2000 Kosmatka et al. ..... 473/291
6,099,413 A * 8/2000 Naylor ..... 473/226
6,139,445 A * 10/2000 Werner et al. ..... 473/330
6,186,905 B1 * 2/2001 Kosmatka ..... 473/291
6,331,149 B1 * 12/2001 Mikame et al. ..... 473/330
6,340,337 B2 * 1/2002 Hasebe et al. ..... 473/349
6,344,002 B1 * 2/2002 Kajita ..... 473/330

* cited by examiner

*Primary Examiner*—Paul T. Sewell
*Assistant Examiner*—Tom P Duong
(74) *Attorney, Agent, or Firm*—Finnegan, Henderson, Farabow, Garrett & Dunner, L.L.P.

(57) ABSTRACT

A golf club head is disclosed, which is capable of setting a head center of gravity projected on a face surface in the vicinity of a face center even when a head thickness excluding a face portion is made uniform or a head volume is increased to a maximum. In this golf club head, in a three-dimensional coordinate axis with a face center set as an origin, a coordinate value of each most bulged position in a head body is specified, and a shape of the head body is brought close to that of symmetry in an upper-lower direction and, more preferably, to that of symmetry in upper-lower and right-left directions.

2 Claims, 6 Drawing Sheets

GOLF CLUB HEAD

BACKGROUND OF THE INVENTION

The present invention relates to a golf club head having a hollow structure. More specifically, the present invention relates to a golf club head having a position of a head center of gravity projected on a face surface set in the vicinity of a face center by improving a head shape.

Conventionally, in many cases, a hollow golf club head used for a wood golf club has had a shape asymmetrical in an upper-lower direction and inverted-trapezoidal when seen from a front side. In the golf club head of such a shape, a head center of gravity is inevitably set high when a head thickness excluding a face portion is made uniform. Thus, by disposing a weight in a sole side of a head body or setting a thickness of a sole portion to be relatively larger, the head center of gravity is lowered such that a position of the head center of gravity projected on a face surface can be set in the vicinity of a face center.

However, there is naturally a limit on total weight of the golf club head. Accordingly, when a weight adjustment is made in order to correct unevenness of mass caused by the above-described head shape, it becomes difficult to add another weight in a backside of the head body in order to increase a depth of the center of gravity. Consequently, there has been a difficulty of making adjustments for a height of the center of gravity and for a depth of the center of gravity at the same time.

In addition, in the conventional golf club head, when a head volume is set large in order to improve stability of a hit ball, an adjustment of a head thickness and an addition of a weight are limited because of the limit on the total weight. Consequently, the unevenness of mass due to the head shape may not be sufficiently corrected, thus causing such a problem that the head center of gravity projected on the face surface can not be set in the vicinity of the face center.

SUMMARY OF THE INVENTION

An object of the present invention is to provide a golf club head capable of setting a head center of gravity projected on a face surface in the vicinity of a face center even when a head thickness excluding a face portion is made uniform, or a head volume is increased to a maximum.

In order to achieve the foregoing object, a golf club head in accordance with the present invention includes: a head body provided with a neck portion for fixing a club shaft in a heel side of a crown portion thereof. In this case, in a state of a face surface of the head body being set as a front, when a geometric face center of the face surface is set as an origin 0; a straight line extended in a right-left toe-heel direction in contact with the face center is set as an X axis; a straight line extended in an upper-lower crown-sole direction in an orthogonal relation to the X axis in contact with the face center is set as a Y axis; and a straight line extended in a forward-backward direction in an orthogonal relation to the X and Y axes is set as a Z axis, an absolute value of a sum of a Y coordinate value (YC) of a most bulged position C in a crown side of the head body and a Y coordinate value (YS) of a most bulged position S in a sole side of the head body is set equal to 2 mm or lower, an absolute value of a difference between a Z coordinate value (ZC) of the most bulged position C in the crown side of the head body and a Z coordinate value (ZS) of the most bulged position S in the sole side of the head body is set equal to 2 mm or lower, and absolute values of a Y coordinate value (YT) of a most bulged position T in a toe side of the head body, a Y coordinate value (YH) of a most bulged position H in a heel side of the head body and a Y coordinate value (YB) of a most bulged position B in a backside of the head body are respectively set equal to 2 mm or lower.

According to the foregoing golf club head, preferably, an absolute value of a sum of an X coordinate value (XT) of the most bulged position T in the toe side of the head body and an X coordinate value (XH) of the most bulged position H in the heel side of the head body is set equal to 2 mm or lower, an absolute value of a difference between a Z coordinate value (ZT) of the most bulged position T in the toe side of the head body and a Z coordinate value (ZH) of the most bulged position H in the heel side of the head body is set equal to 2 mm or lower, and absolute values of an X coordinate value (XC) of the most bulged position C in the crown side of the head body, an X coordinate value (XS) of the most bulged position S in the sole side of the head body and an X coordinate value (XB) of the most bulged position B in the backside of the head body are respectively set equal to 2 mm or lower.

Thus, in a three-dimensional coordinate axis with the face center set as the origin, by defining the coordinate value of each most bulged position in the head body within the foregoing range and bringing a shape of the head body close to that of symmetry in an upper-lower direction, more preferably to that of symmetry in upper-lower and right-left directions, a position of a head center of gravity projected on the face surface can be set in the vicinity of the face center without disposing any weights in the sole side or increasing a thickness of the sole portion. If there is room for further addition of a weight, it is possible to set the head center of gravity much lower and deeper. Moreover, even when a head thickness is reduced within a range permitted by a strength, and a head volume is increased to a maximum, the head center of gravity projected on the face surface can be set in the vicinity of the face center.

According to the present invention, the geometrical face center of the face surface is a centroid of the face surface. In addition, the X axis as the straight line extended in the right-left toe-heel direction is an axis parallel to an installation surface (ground surface) when the golf club head is installed according to a lie angle.

In this case, the installation according to the lie angle means a state where spaces between a round of the sole surface of the head and the installation surface as a plane surface are roughly equal to each other in the toe and heel sides. If the round of the sole surface is ambiguous, a score line and the installation surface are set parallel to each other. If the parallel state with the installation surface cannot be determined, e.g., the round of the sole surface is ambiguous, or the score line is not straight, a lie angle (degree)=(100−club length (inch)) is set. For example, when a club length is 44 inches, a lie angle is 100−44=56°.

A club length is measured by a traditional standard measuring method set as a standard by The Japan Golf Goods Association. That is, a length is set from a contact between a sole surface of a head and a back of a neck portion to a grip end (not including a round cap portion). For a measuring device, a Club Measure II by Kamoshita Seikoujo Co., Ltd. may be used.

DETAILED DESCRIPTION OF THE PREFERRED EMBODIMENT

Next, detailed description will be made of a constitution of the present invention with reference to the accompanying drawings.

Figure 1:
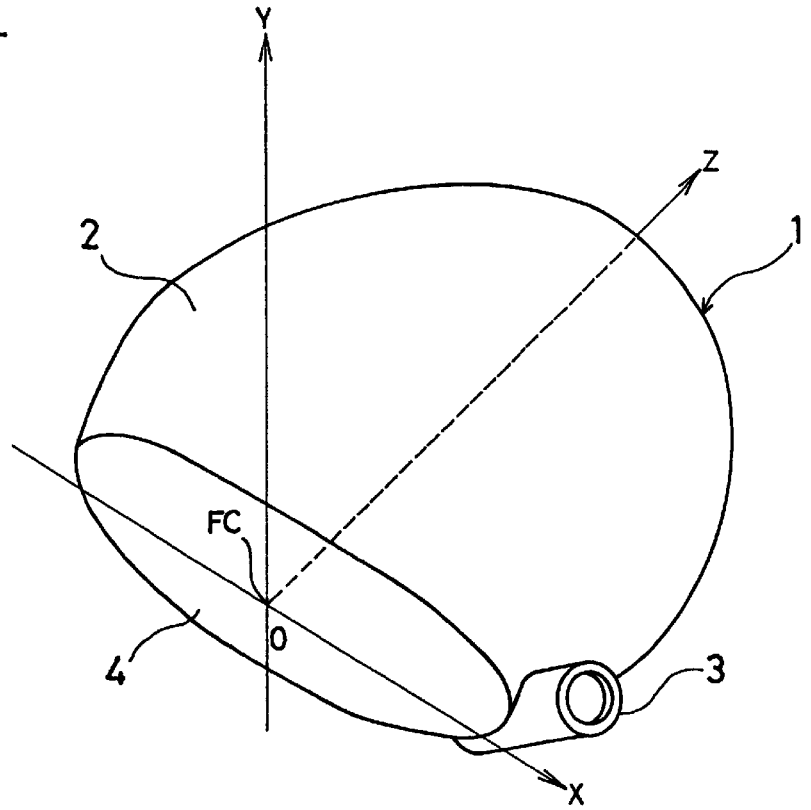
FIG. 1 is a perspective view showing a golf club head according to an embodiment of the present invention.
Figure 2:
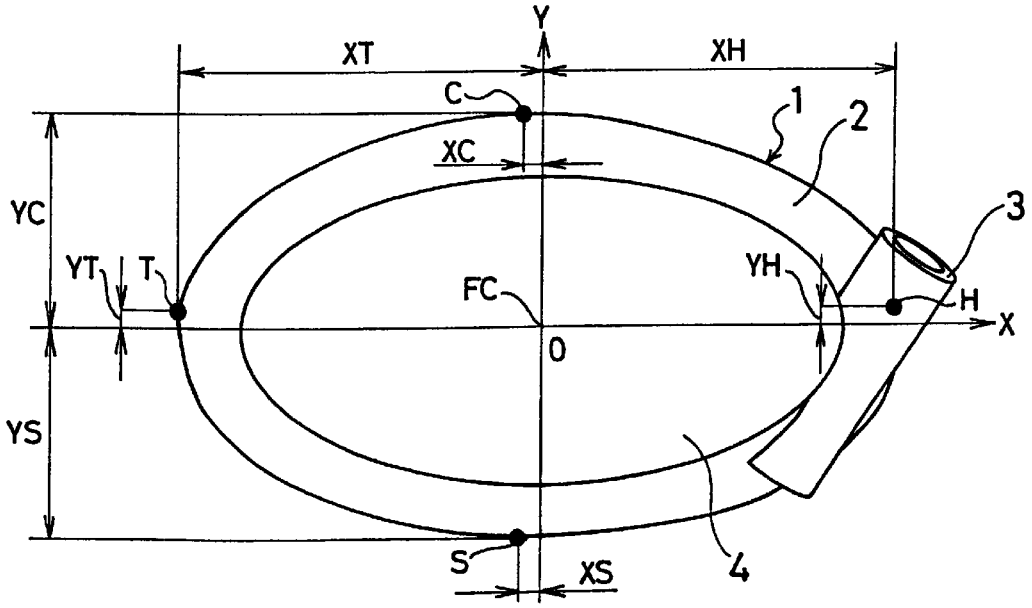
FIG. 2 is a front view of the golf club head shown in FIG. 1.
Figure 3:
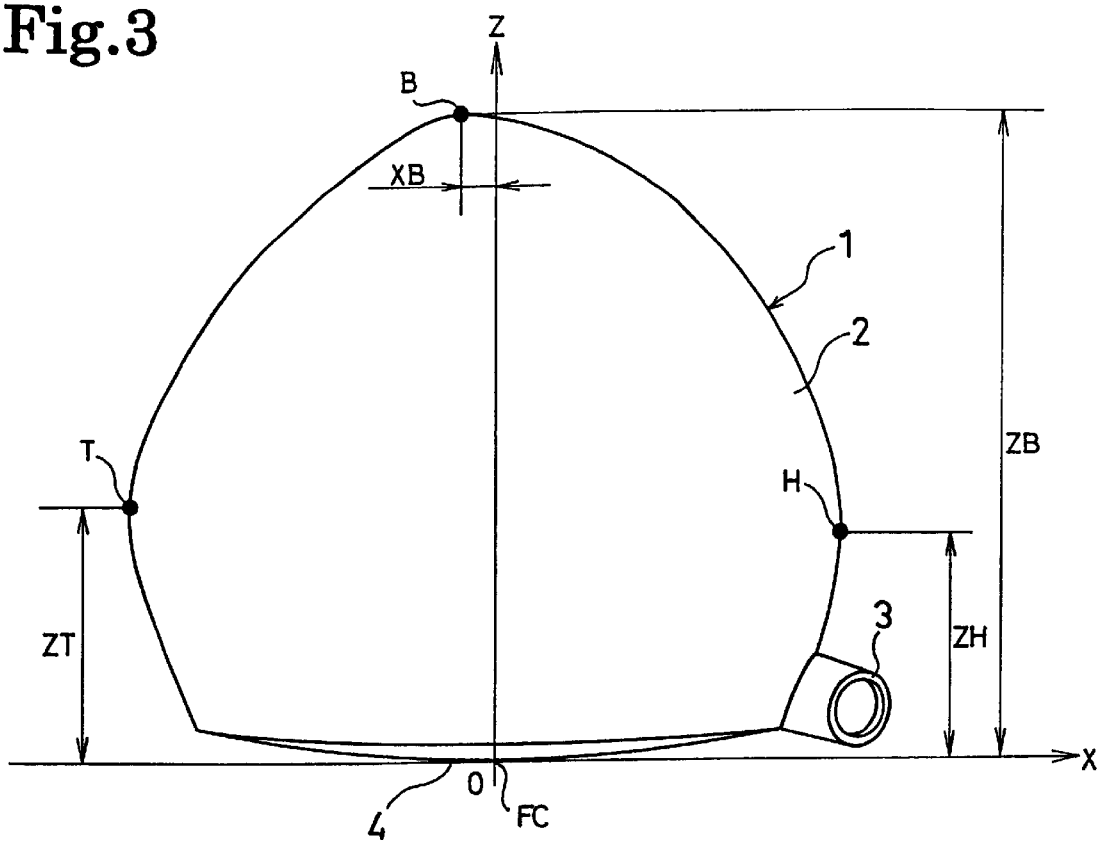
FIG. 3 is a plan view of the golf club head shown in FIG. 1.
Figure 4:
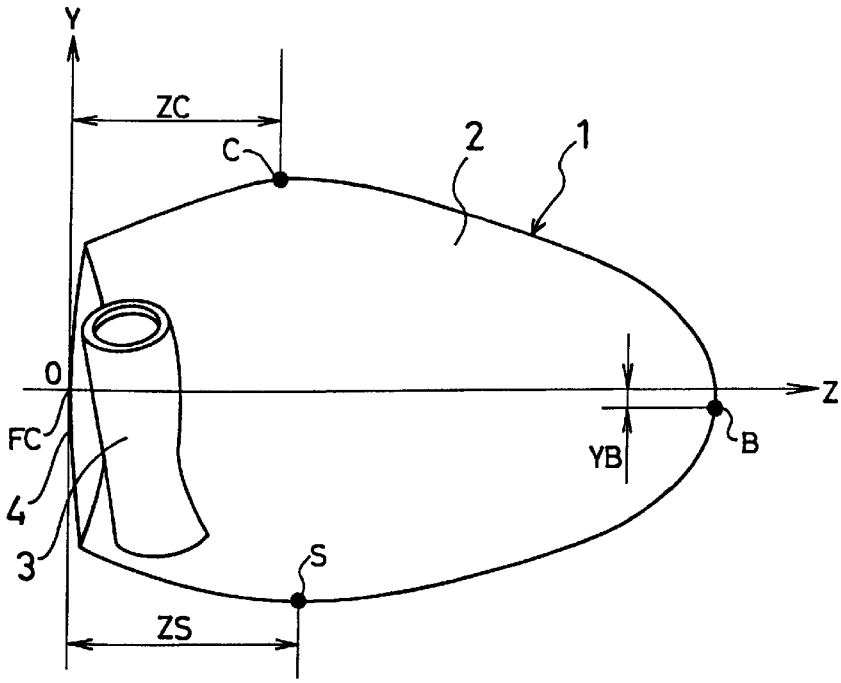
FIG. 4 is a side view of the golf club head shown in FIG. 1.
Figure 9:
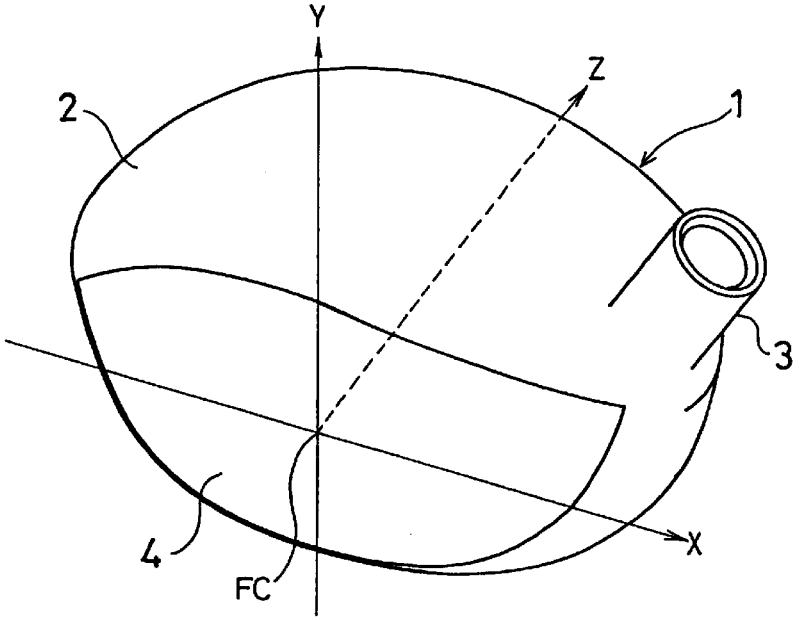
Fig.9 PRIOR ART
FIG. 9 is a perspective view showing a conventional golf club head.
Figure 10:
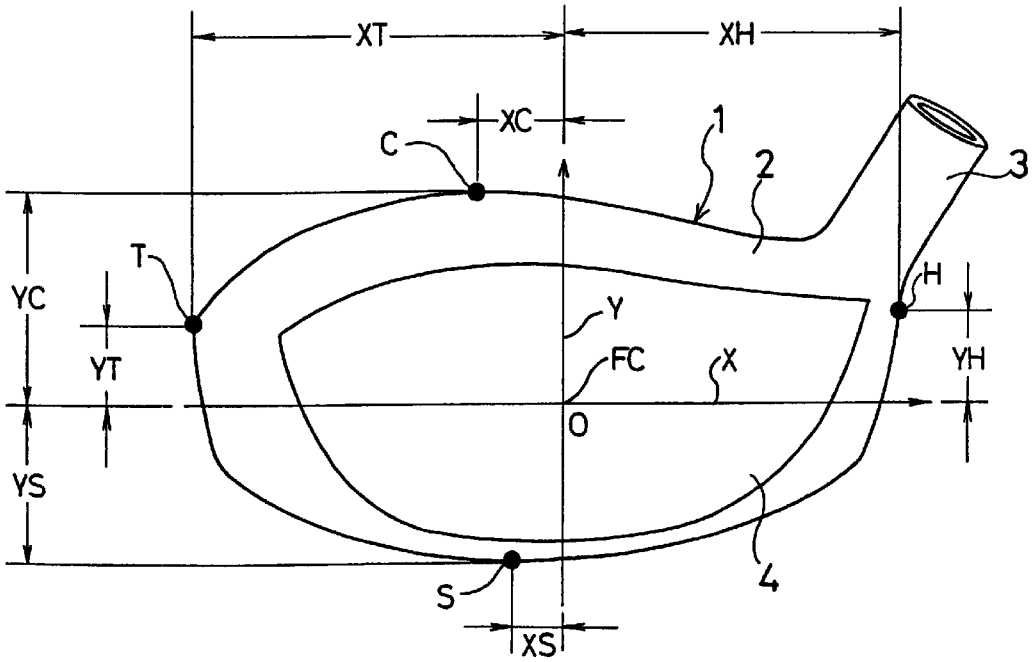
Fig.10 PRIOR ART
FIG. 10 is a front view of the golf club head shown in FIG. 9.
Figure 11:
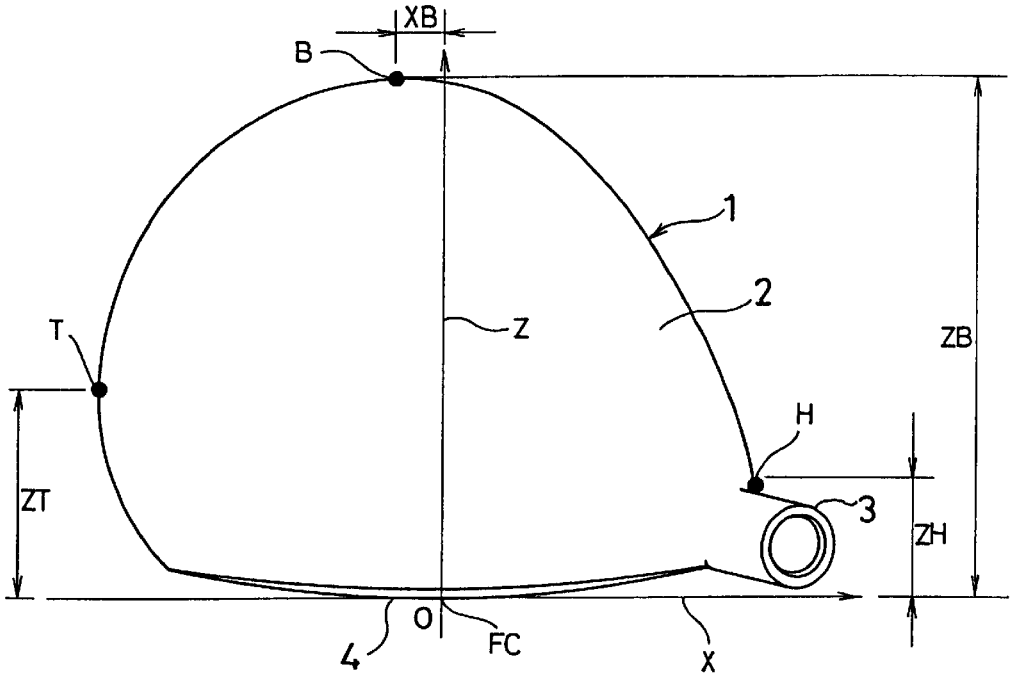
Fig.11 PRIOR ART
FIG. 11 is a plan view of the golf club head shown in FIG. 9.
Figure 12:
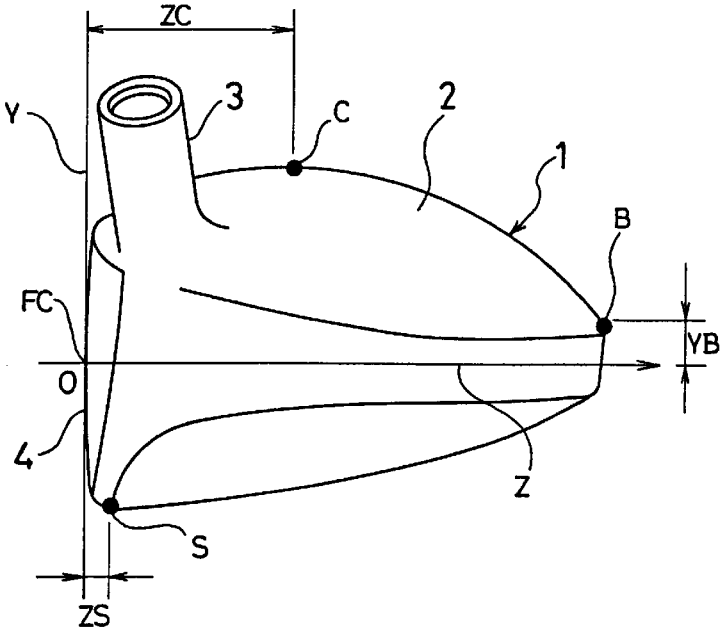
Fig.12 PRIOR ART
FIG. 12 is a side view of the golf club head shown in FIG. 9.

Each of FIGS. 1 to 4 shows a golf club head according to an embodiment of the present invention. On the other hand, each of FIGS. 9 to 12 shows an example of a conventional golf club head. The golf club head of the embodiment includes a metallic head body 1 having a hollow structure, and a neck portion 3 integrally provided in a heel side of a crown portion 2. The neck portion 3 is provided for fixing a not-shown club shaft.

Now, in a state of a face surface 4 of the head body 1 being set as a front, a geometric face center FC of the face surface 4 is set as an origin 0; a straight line extended in a right-left toe-heel direction in contact with the face center FC is set as an X axis; a straight line extended in an upper-lower crown-sole direction in an orthogonal relation to the X axis in contact with the face center FC is set as a Y axis; and a straight line extended in a forward-backward direction in an orthogonal relation to the X and Y axes is set as a Z axis.

In addition, an X coordinate value of a most bulged position C in the crown side of the head body 1 is set as XC; a Y coordinate value of the most bulged position C is set as YC; and a Z coordinate value of the most bulged position C is set as ZC. An X coordinate value of a most bulged position S in the sole side of the head body 1 is set as XS; a Y coordinate value of the most bulged position S is set as YS; and a Z coordinate value of the most bulged position S is set as ZS. An X coordinate value of a most bulged position T in the toe side of the head body 1 is set as XT; a Y coordinate value of the most bulged position T is set as YT; and a Z coordinate value of the most bulged position T is set as ZT. An X coordinate value of a most bulged position H in a heel side of the head body 1 is set as XH; a Y coordinate value of the most bulged position H is set as YH; and a Z coordinate value of the most bulged position H is set as ZH. An X coordinate value of a most bulged position B in the backside of the head body 1 is set as XB; a Y coordinate value of the most bulged position B is set as a YB; and a Z coordinate value of the most bulged position B is set as ZB.

According to the present invention, in order to make weight balance in a crown-sole direction of the head body 1 uniform, in a three-dimensional coordinate axis with the face center FC set as an origin, the coordinate value of each most bulged position in a head body 1 is set as follows.

That is, an absolute value of a sum of the Y coordinate value (YC) of the most bulged position C in the crown side and the Y coordinate value (YS) of the most bulged position S in the sole side is set equal to 2 mm or lower, thus realizing a relation of $|YC+YS| \leqq 2$ mm.

An absolute value of a difference between the Z coordinate value (ZC) of the most bulged position C in the crown side and the Z coordinate value (ZS) of the most bulged position S in the sole side is set equal to 2 mm or lower, thus realizing a relation of $|ZC-ZS| \leqq 2$ mm.

Absolute values of the Y coordinate value (YT) of the most bulged position T in the toe side, the Y coordinate value (YH) of the most bulged position H in the heel side and the Y coordinate value (YB) of the most bulged position B in the backside are respectively set equal to 2 mm or lower, thus realizing relations of $|YT| \leqq 2$ mm, $|YH| \leqq 2$ mm, and $|YB| \leqq 2$ mm.

Thus, by defining the coordinate value of each most bulged position in the head body 1 within the foregoing range and by bringing a shape of the head body 1 close to that of symmetry in an upper-lower direction, a position of a head center of gravity projected on the face surface 4 is set in the vicinity of the X axis passing through the face center FC. However, if each defined value is out of the foregoing range, when a head thickness excluding the face portion is made uniform, it is difficult to set the position of the head center of gravity projected on the face surface 4 in the vicinity of the X axis.

Furthermore, according to the present invention, in order to make weight balance in the toe-heel direction of the head body 1 uniform, in a three-dimensional coordinate axis with the face center FC set as an origin, the coordinate value of each most bulged position of the head body 1 is set as follows.

That is, an absolute value of a sum of the X coordinate value (XT) of the most bulged position T in the toe side and the X coordinate value (XH) of the most bulged position H in the heel side is set equal to 2 mm or lower, thus realizing a relation of $|XT+XH| \leqq 2$ mm.

An absolute value of a difference between the Z coordinate value (ZT) of the most bulged position T in the toe side and the Z coordinate value (ZH) of the most bulged position H in the heel side is set equal to 2 mm or lower, thus realizing a relation of $|ZT-ZH| \leqq 2$ mm.

Absolute values of the X coordinate value (XC) of the most bulged position C in the crown side, the X coordinate value (XS) of the most bulged position S in the sole side, and the X coordinate value (XB) of the most bulged position B in the backside are respectively set equal to 2 mm or lower, thus realizing relations of $|XC| \leqq 2$ mm, $|XS| \leqq 2$ mm, and $|XB| \leqq 2$ mm.

Thus, by defining the coordinate value of each most bulged position in the head body 1 within the foregoing range and by bringing a shape of the head body 1 close to that of symmetry in a right-left direction, a position of a head center of gravity projected on the face surface 4 is set in the vicinity of the Y axis passing through the face center FC. However, if each defined value is out of the foregoing range, when a head thickness excluding a face portion is made uniform, it is difficult to set the position of the head center of gravity projected on the face surface 4 in the vicinity of the Y axis.

Figure 5:
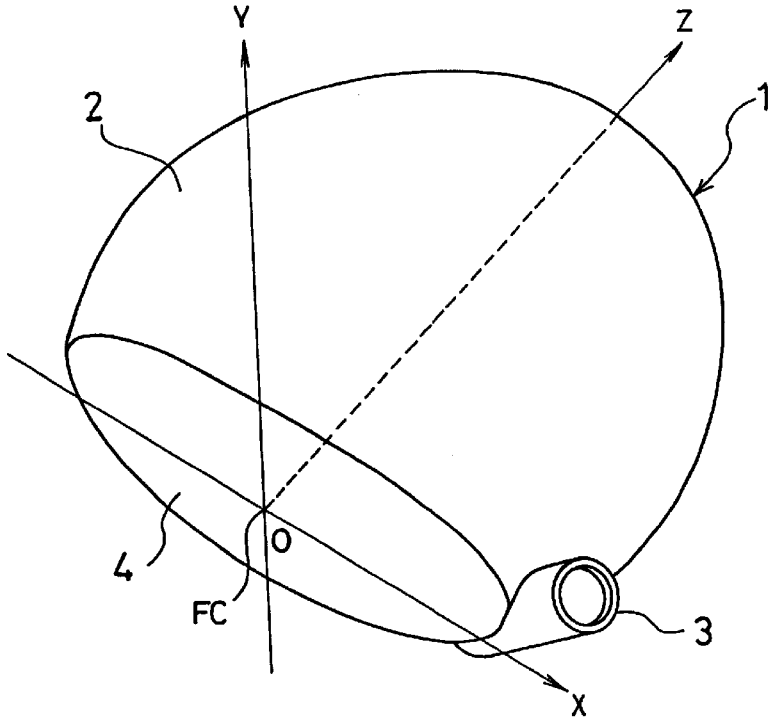
FIG. 5 is a perspective view showing a golf club head according to a most preferred embodiment of the present invention.
Figure 6:
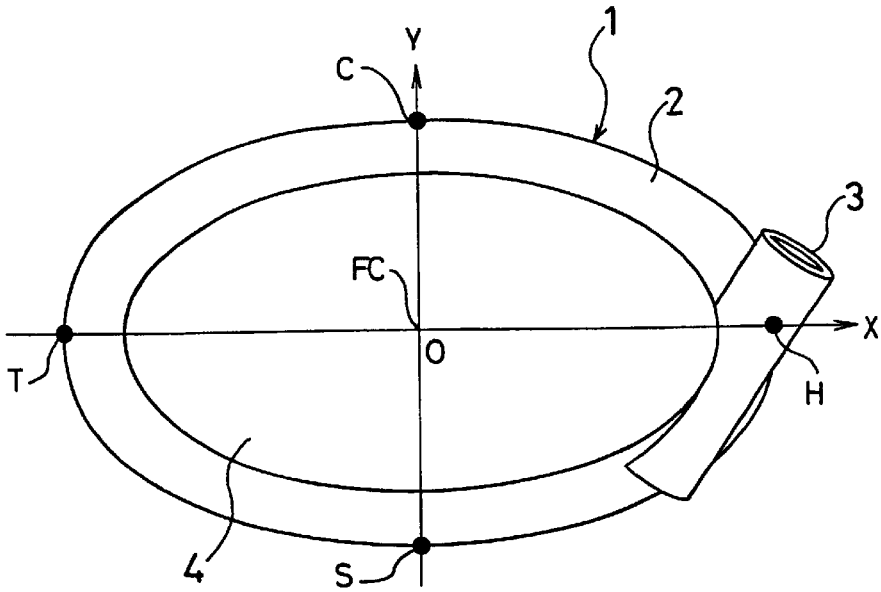
FIG. 6 is a front view of the golf club head shown in FIG. 5.
Figure 7:
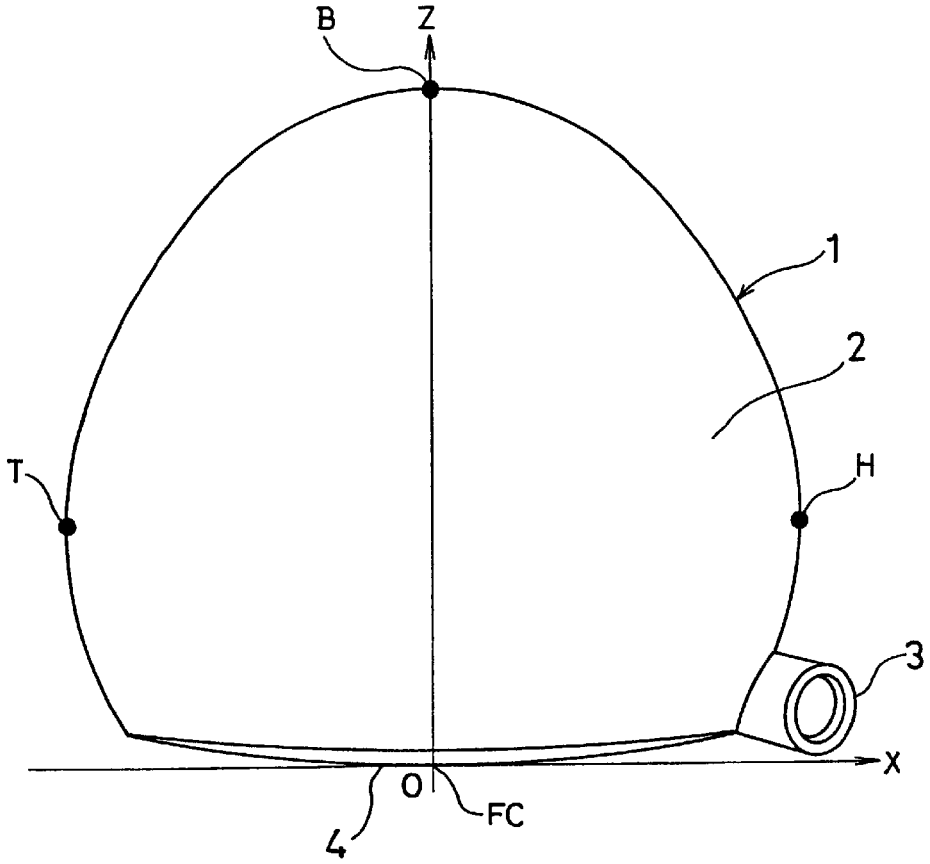
FIG. 7 is a plan view of the golf club head shown in FIG. 5.
Figure 8:
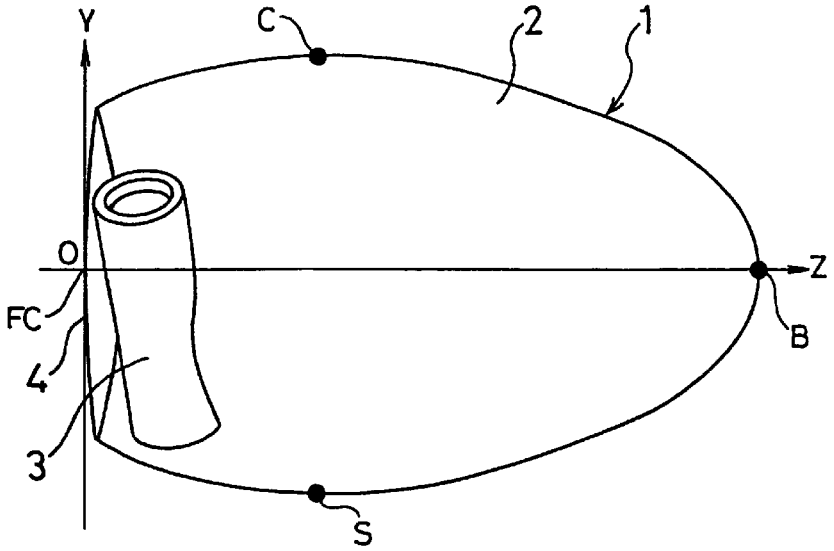
FIG. 8 is a side view of the golf club head shown in FIG. 5.

Each of FIGS. 5 to 8 shows a golf club head according to the most preferred embodiment of the present invention. In the embodiment, the foregoing defined values (|YC+YS|, |ZC−ZS|, |YT|, |YH|, |YB|, |XT+XH|, |ZT−ZH|, |XC|, |XS| and |XB|) are all set equal to 0 mm, and a shape of the head body 1 is brought close to that of symmetry in upper-lower and right-left directions. Thus, when the head body 1 is formed roughly in such a complete symmetrical shape, by making a head thickness excluding a face portion uniform, it is possible to match a position of a head center of gravity projected on the face surface 4 with the face center FC.

According to the present invention, without disposing any weights in the sole side or increasing a thickness of the sole portion, the position of the head center of gravity projected on the face surface 4 can be set in the vicinity of the face center FC. Moreover, if there is room for further addition of a weight considering the limit on the total weight of the head body 1, by disposing a weight in the sole side or increasing the thickness of the sole portion, it is possible to set the center of gravity of the head body 1 much lower and deeper.

In addition, even when the head thickness is reduced within a range permitted by a strength and a head volume is increased to a maximum, the position of the head center of gravity projected on the face surface 4 can be set in the vicinity of the face center FC.

In the foregoing golf club head, a loft angle is set such that the face surface 4 can be inclined with respect to a shaft axis when a shaft is fixed in the neck portion 3. Accordingly, while a golf club is in a ready state for use, the head body 1 has its backside inclined downward. When such a golf club is swung, the head body 1 draws an upper-blowing line (trajectory from lower to upper) during ball hitting, and thus a low-spin ball can be hit out, contributing to an increase of a carry.

EXAMPLE

The head of the present invention shown in each of FIGS. 1 to 4 and the conventional head shown in each of FIGS. 9 to 12 were made of same materials, dimensions thereof were respectively set as shown in Tables 1 and 2, and positions of head centers of gravity projected on face surfaces were disposed in the vicinities of face centers. However, a head thickness excluding a face portion was made uniform in the head of the present invention, while a thickness of a sole portion was set relatively large to adjust the head center of gravity in the conventional head.

TABLE 1

Unit: mm

| | Conventional head | | | Head of the present invention | | |
|---|---|---|---|---|---|---|
| | X | Y | Z | X | Y | Z |
| Most bulged position C in crown side | −11.9 | 30.9 | −33.0 | 0.0 | 31.7 | −35.6 |
| Most bulged position S in sole side | −7.7 | −22.4 | −3.5 | 0.1 | −31.7 | −35.3 |
| Most bulged position T in toe side | −55.4 | 10.6 | −33.9 | −53.8 | 0.4 | −35.5 |
| Most bulged position H in heel side | 50.0 | 11.3 | −14.9 | 53.9 | 1.3 | −35.7 |
| Most bulged position B in backside | −7.6 | 4.9 | −83.3 | 0.0 | 0.0 | −100.0 |

TABLE 2

| Unit: mm | Conventional head | Head of the present invention |
|---|---|---|
| \|YC + YS\| | 8.5 | 0.0 |
| \|ZC − ZS\| | 29.5 | 0.3 |
| \|YT\| | 10.6 | 0.4 |
| \|YH\| | 11.3 | 1.3 |
| \|YB\| | 4.9 | 0.0 |
| \|XT + XH\| | 5.4 | 0.1 |
| \|ZT − ZH\| | 19.0 | 0.2 |
| \|XC\| | 11.9 | 0.0 |
| \|XS\| | 7.7 | 0.1 |
| \|XB\| | 7.6 | 0.0 |

Volumes of the foregoing heads were compared with each other. As a result, the head of the present invention increased its head volume by 30% compared with that of the conventional head.

According to the present invention, in the three-dimensional coordinate axis with the face center set as the origin, by specifying the coordinate value of each most bulged position in the head body, it is possible to set the head center of gravity projected on the face surface in the vicinity of the face center even when the head thickness excluding the face portion is made uniform or the head volume is increased to the maximum.

The preferred embodiment of the present invention has been described. However, it should be understood that various changes and modifications, replacements or substitutions can be made without departing from a spirit and a scope of the present invention as defined by appended claims.

What is claimed is:

1. A golf club head comprising:

a head body provided with a neck portion for fixing a club shaft in a heel side of a crown portion thereof, wherein in a state of a face surface of the head body being set as a front, when a geometric face center of the face surface is set as an origin 0; a straight line extended in a right-left toe-heel direction in contact with the face center is set as an X axis; a straight line extended in an upper-lower crown-sole direction in an orthogonal relation to the X axis in contact with the face center is set as a Y axis; and a straight line extended in a forward-backward direction in an orthogonal relation to the X and Y axes is set as a Z axis, an absolute value of a sum of a Y coordinate value (YC) of a most bulged position C in a crown side of the head body and a Y coordinate value (YS) of a most bulged position S in a sole side of the head body is set equal to 2 mm or lower, an absolute value of a difference between a Z coordinate value (ZC) of the most bulged position C in the crown side of the head body and a Z coordinate value (ZS) of the most bulged position S in the sole side of the head body is set equal to 2 mm or lower, and absolute values of a Y coordinate value (YT) of a most bulged position T in a toe side of the head body, a Y coordinate value (YH) of a most bulged position H in a heel side of the head body and a Y coordinate value (YB) of a most bulged position B in a backside of the head body are respectively set equal to 2 mm or lower.

2. The golf club head according to claim 1, wherein an absolute value of a sum of an X coordinate value (XT) of the most bulged position T in the toe side of the head body and an X coordinate value (XH) of the most bulged position H in the heel side of the head body is set equal to 2 mm or lower, an absolute value of a difference between a Z coordinate value (ZT) of the most bulged position T in the toe side of the head body and a Z coordinate value (ZH) of the most bulged position H in the heel side of the head body is set equal to 2 mm or lower, and absolute values of an X coordinate value (XC) of the most bulged position C in the crown side of the head body, an X coordinate value (XS) of the most bulged position S in the sole side of the head body and an X coordinate value (XB) of the most bulged position B in the backside of the head body are respectively set equal to 2 mm or lower.

* * * * *